United States Patent [19]

Tanaka et al.

[11] Patent Number: 4,797,340

[45] Date of Patent: Jan. 10, 1989

[54] DRY ELECTROPHOTOGRAPHIC TONER COMPRISING GRAFT COPOLYMER

[75] Inventors: Koichi Tanaka; Shigeo Aonuma; Yoshimi Amagai; Toshiaki Murofushi; Takaaki Kimura, all of Kanagawa, Japan

[73] Assignee: Fuji Xerox Co., Ltd., Tokyo, Japan

[21] Appl. No.: 71,520

[22] Filed: Jul. 9, 1987

Related U.S. Application Data

[63] Continuation of Ser. No. 749,980, Jun. 28, 1985, abandoned.

[30] Foreign Application Priority Data

Jun. 29, 1984 [JP] Japan ..... 59-134773

[51] Int. Cl.[4] ..... G03G 9/08

[52] U.S. Cl. ..... 430/109; 430/904

[58] Field of Search ..... 430/109, 904

[56] References Cited

U.S. PATENT DOCUMENTS

| | | | |
|---|---|---|---|
| 3,595,794 | 7/1971 | Hagenbach et al. | 430/108 |
| 3,736,257 | 5/1973 | Miller | 430/108 |
| 3,985,664 | 10/1976 | Sakaguchi et al. | 430/109 |
| 4,049,447 | 9/1977 | Azar et al. | 430/107 X |
| 4,385,107 | 5/1983 | Tonaka et al. | 430/904 |

*Primary Examiner*—J. David Welsh

*Attorney, Agent, or Firm*—Sughrue, Mion, Zinn, Macpeak and Seas

[57] ABSTRACT

Dry toners for use in electrostatic latent image development comprising a colorant in a resin binder are described, wherein said resin binder comprises a polyester containing —COOH groups in which at least one of the —COOH groups is replaced with nitrogen-containing compounds such as amines, ammonium salts, betaines, pyridinium salts, and azines. These toners are superior in development of negatively charged latent images and exhibit good low temperature fixability.

19 Claims, No Drawings

DRY ELECTROPHOTOGRAPHIC TONER COMPRISING GRAFT COPOLYMER

This is a continuation of application Ser. No. 749,980 filed June 28, 1985, now abandoned.

FIELD OF THE INVENTION

The present invention relates to dry toners for use in development of latent images in electrophotography, electrostatic recording, electrostatic printing, etc. More particularly, this invention relates to toners which are superior in development of negatively charged latent images and which exhibit good low temperature fixability.

BACKGROUND OF THE INVENTION

In producing copies of printed matter, for example, by an electrophotographic technique, a latent image is first formed on a light-sensitive material or a dielectric film, and then the latent image is developed by adhering particles, collectively referred to as toner, to the latent image, said toner comprising a binder resin with a colorant dispersed therein. Thereafter, the resulting toner image is transferred to a substrate such as paper and then fixed, for example, by heating. Although techniques such as a solvent method and an overcoating method are known for the fixation of the toner image, a heat-fixing method is commonly employed in which the toner image is heated to a temperature at which the toners become fluid and then is brought into contact with a substrate, thereby allowing the toners to be fixed to the substrate. In order to increase copying speed, a so-called heat roll fixing method, in which a substrate with the toner image transferred thereto is passed between a pair of rolls, i.e., a heating roll and a pressing roll, has been widely used as the heat-fixing method.

The heat roll fixing method has various advantages over the other heat-fixing methods. For example, heat efficiency is high, heat dissipation is reduced, and rapid fixation is possible. Thus, it is a very useful fixing method.

The heat roll fixing method, however, is liable to be subject to a phenomenon that part of the toner image sticks to the heating roll or pressing roll when it comes into contact therewith. This is referred to as an offset phenomenon. To prevent this offset phenomenon, a procedure has been employed in which the roll surface is covered with a material having superior releasing properties, such as a fluorine resin, and furthermore an offset-preventing liquid such as silicone oil is applied to the roll surface. This procedure enables prevention of the offset phenomenon to a certain extent, but suffers from various disadvantages. For example, (1) it requires the offset-preventing liquid, (2) it requires an additional apparatus for supplying the offset-preventing liquid to the roll surface in a constant amount, (3) there is a danger of oil leakage, and (4) the offset-preventing liquid tends to generate unpleasant odor on heating.

In recent years, therefore, many attempts have been made to perform heat roll fixation without the use of the offset-preventing liquid. One such method is described in Japanese Patent Pulbication No. 5549/78. Another method is to modify toners themselves so that it is not necessary to use the offset-preventing liquid. Such a method is described in Japanese Patent Application (OPI) Nos. 42354/74, 65231/74, 652d32/74, 107743/74, 11240/75, 27546/75, 28840/75, 81342/75, 85338/75, 93646/75, 93647/75, 134652/75, and 144446/75 (the term "OPI" as used herein means a "published uexamined Japanese patent application"). The method of preventing the offset phenomenon in the heat roll fixation by the modification of the toners themselves without the use of the offset-preventing liquid is satisfactory to prevent the offset phenomenon but is not always satisfactory to meet other properties required for dry toners. That is, among the individual toner particles the friction charge amount is greatly different, and as the result, there are incorporated various toner particles of from those having a small charge amount to those having a large charge amount, i.e., the toner chrage spectrum is extremely broad. Further, there may be caused incorporation of the desired toners and those having an opposite polarity thereto.

In order to overcome to the above problem, dry toners have been proposed in which as the biner resin a graft copolymer comprising (a) a crystalline polymer portion of at least one monomer selected from ethylene, propylene, and vinyl acetate, (b) an unsaturated polyester portion, and (c) a vinyl polymer portion, wherein (a) and (b) constitute a main chain and (c) constitutes a side chain, is used. These toners not only overcome the above-described problem, but also produce the advantages that fixation at low temperatures is possible and the temperature range in which fixation is possible can be extended. That is, they overcome many of the disadantages of conventional toners. The same is applied in U.S. Pat. No. 4,385,107.

It has been found, however, that although the toners referred to in the preceding are superior as negatively charged toners for use in development of positive electrostatic latent images, they are unsuitable as positively charged toners for use in development of negative electrostatic latent images, for example, of zinc oxide. This is believed to be due to the fact that the toners contain the noted unsaturated polyester portion.

As positively charged toners, toners prepared using a styrene-acrylic resin as a binder resin are generally suitable. Such toners, however, have a disadvantage in that their fixability at low temperatures is poor.

In order to render the toners containing the polyester portion positively chargeable, the present inventors made an attempt to incorporate a positive charge controlling agent such as ammonium salts, pyridinium salts, and azines. As the result, while positively chargeable toners can be obtained, there are caused blocking of the toners, reduction in powder fluidity of the toners, and marked increase in fixation temperature. This is believed to be due to the fact that the positive charge controlling agent incorporated is exposed on the surface by a bleeding phenomenon. Further, if these toners are mixed with carriers to prepare a developer, there is caused a so-called toner impaction phenomenon in which the carrier surfaces are contaminated by the toners.

SUMMARY OF THE INVENTION

An object of the present invention is to provide toners which can be fixed at low temperatures, have an extended fixation temperature range (i.e., an extended temperature range wherein fixation is possible), which enable prevention of the offset phenomenon without the use of an offset-preventing liquid, and which are superior in positive-to-positive development of negatively charged latent image-forming media.

Another object of the present invention is to provide positively chargeable toners having a friction chargeability property which is reduced in temperature dependency.

Still another object of the present invention is to provide positively chargeable toners which do not contaminate the carrier and do not cause blocking.

As a result of extensive investigations, a toner satisfying the foregoing objects has now been discovered.

That is, the present invention is directed to a dry toner prepared using a polyester containing —COOH groups in which at least one of the —COOH groups is modified with a nitrogen-containing functional group selected from an amine, an ammonium salt, a betaine, a pyridinium salt, and an azine.

Furthermore, it has been found that the above objects are attained by using a graft copolymer:

(a) a crystalline main chain-polymer portion of at least one monomer selected from the group consisting of ethylene, propylene, and vinyl acetate, (b) an unsaturated polyester main chain-polymer portion containing —COOH groups in which at least one of the —COOH groups is modified with a nitrogen-containing functional group selected from an amine, an ammonium salt, a betaine, a pyridinium salt, and an azine, and (c) a vinyl side chain-polymer portion.

The present invention relates to a dry toner containing as a binder resin a graft copolymer containing the above-described portions (a), (b), and (c).

DETAILED DESCRIPTION OF THE INVENTION

The graft copolymer according to the present invention belongs to the group of copolymers that can be generally represented as shown below.

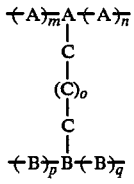

wherein A represents a repeating monomer unit constituting the crystalline polymer portion, B represents a repeating monomer unit constituting the unsaturated polymer portion, and C represents a repeating monomer unit constituting the vinyl polymer portion. These portions containing A, B, and C may each be a homopolymer or a copolymer. The graft copolymer side chain portion containing portion C units may be bonded at any point of the graft copolymer main chain portion containing A units and any point of the graft copolymer main chain portion containing B units. A plurality of branch portions may be present along the stem portion.

The graft copolymer can be prepared by graft polymerizing previously polymerized polymer chains which constitute the main chain portion with monomers which constitute the side chain portion, for example, by the following methods: (1) free radicals are formed in the polymer chain by irradiation, for example, and then other monomers are polymerized in the presence of the above-treated polymer, (2) active sites are introduced into the polymer chain by oxidation to form a peroxide group acting as a free radical initiator, and, thereafter, other monomers are polymerized, and (3) functional groups are introduced into the polymer chain and then other monomers are polymerized, or, alternatively, other monomers are polymerized utilizing functional groups originally present in the polymer chain. From the viewpoints of the choice of the polymer portion and the control of degree of grafting, it is preferred that the vinyl monomers are graft polymerized as side chain portions on the crystalline polymer and unsaturated polyester resin which have been previously produced.

The best results are obtained when the graft copolymer has a glass transition point (Tg) of from 40° to 70° C., a number average molecular weight ($\overline{M}n$) of from 1,000 to 10,000, and a weight average molecular weight ($\overline{M}w$) of from 30,000 to 500,000.

In connection with each crystalline main chain-polymer portion constituting the graft copolymer, when its melting point ($T_M$) is from 45° to 200° C., the best results are obtained. If the melting point is less than 45° C., the resulting toners readily coagulate at room temperature (about 20° C.). This leads not only to solidification of the toners during the storage or transportation, but also to solidification in a developing apparatus. As a result, undesirable problems occur, including poor stirability of a developer, and the formation of a toner bridge in a toner hopper. On the other hand, if the melting point is more than 200° C., a low temperature fixation becomes impossible. That is, the toners do not melt flow in the temperature range that is commonly used in the heat roll fixation, and no satisfactory fixation can be attained unless the heat roll temperature is increased to a considerably high level. The glass transition point is 20° C. or less, and preferably from 20° to −100° C. The number average molecular weight is preferably from 1,000 to 20,000 and the weight average molecular weight is preferably from 2,000 to 100,000. The crystalline main chain-polymer portion is formed of one or more of ethylene, propylene, and vinyl acetate.

Preferred examples of such crystalline main chain-polymers are polyethylene, polypropylene, an ethylene/propylene copolymer, and an ethylene/vinyl acetate copolymer.

The term "crystalline polymer" as used herein includes polymers which exhibit a sharp and definite melting point and which are insoluble and become turbid in solvents at room temperature, and polymers containing such polymer portions.

In the case that polyethylene, polypropylene, or an ethylene/propylene copolymer is used as the crystalline main chain-polymer portion, it is preferred for them to have such a relatively low molecular weight that the number average molecular weight is from 1,500 to 7,000 and the weight average molecular weight is from 2,000 to 15,000.

In the case of the ethylene/vinyl acetate copolymer, it is not always necessary that the molecular weight be low. It is sufficient that the glass transition point is at least 20° C.

When vinyl acetate is used as a comonomer, the proportion of vinyl acetate in the crystalline main chain-polymer portion is generally from 10 to 40% by weight, and preferably from 10 to 20% by weight.

The unsaturated polyester main chain-polymer portion constituting the graft copolymer to be used in the preparation of the toners of the present invention is preferred to have a glass transition point of from 40° to 70° C. If the glass transition point is less than 40° C., as described above, the toners readily cause coagulation at room temperature. On the other hand, if it is more than 70° C., low temperature fixation becomes impossible. Best results are obtained when the number average molecular weight is from 500 to 10,000 and the weight average molecular weight is from 1,000 to 20,000. The term "unsaturated polyester main chain-polymer portion" as used herein means a portion composed of polyester containing an unsaturated bond in the main chain thereof, and constituting a main chain-portion of the graft copolymer. The unsaturated polyester main chain-polymer constituting the main chain-portion is prepared from at least one dihydric alcohol selected from the Group J as described hereinafter and at least one dibasic acid selected from the Group K also as described hereinafter. The dibasic acid selected from the Group K contains at least unsaturated dicarboxylic acid (e.g., fumaric acid, maleic acid, and itaconic acid).

Group J: Ethylene glycol, triethylene glycol, 1,2-propylene glycol, 1,3-propylene glycol, 1,4-butanediol, neopentyl glycol, 1,4-butenediol, 1,4-bis(hydroxymethyl)-cyclohexane, bisphenol A, hydrogenated bisphenol A, and polyoxyethylenated bisphenol A.

Group K: Maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, or anhydrides or lower alcohol esters thereof.

The above unsaturated polyester main chain-polymer portio may contain as a monomer component at least one of alcohols having a valency of three or more or carboxylic acids as shown below as the group L.

Group L: Glycerin, trimethylolpropane, pentaerythritol, trimellitic acid, pyromellitic acid.

By using polyesters in which part of terminal —COOH groups and side-chain —COOH groups are modified with nitrogen-containing functional groups such as amines, ammonium salts, betaines, pyridinium salts, and azines, only the polarity can be reversed relative to the same carrier without exerting adverse influences on the thermal and mechanical properties of the material such as fixability, blocking properties, and pulverization properties.

Modification of the —COOH group with amines, for example, can be achieved by reacting modifiers containing functional groups reactive with —COOH (e.g., $NH_2$, OR, and X (wherein R is an alkyl group and X is a halogen atom)) in combination with $NH_2$, —NHR, —$NR_2$, etc., after the polymerization of the polyester or after the graft polymerization.

Modifiers which can be used for this purpose include diethanolamine, dimethylaminoethanol, triethanolamine, oxazolidine, polyphenyl biguanide, polyalkyleneamine, diethylenetriamine, triethylenetetramine, 2-mono-hydroxyethylamino-4,6-diamino-s-triazine, 2-isopropoxy-4,6-diamino-s-triazine, and 2-methoxy-4,6-diamino-s-triazine.

The amine can be converted into the coresponding ammonium salt by adding quaterization agents such as

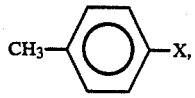

$(CH_3)_2SO_4$, and $CH_3X$ (wherein X is a halogen atom) after the amine modification of the polyester COOH.

Similarly, the amine can be converted into the corresponding betaine by adding betanization agents such as $ClCH_2COONa$ and

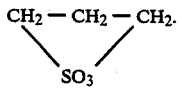

The conversion of amine into azine or pyridinium chloride can be carried out in the same manner as above.

The index of modification of —COOH in the polyester portion into amine, for example, can be represented by the expression $$\frac{A.V._0 - A.V.}{A.V._0} \times 100$$

wherein $A.V._0$ represents the acid value of the polyester prior to the modification, and A.V. represents the acid value of the polyester after the modification. It is necessary that the index of modification be at least 10, preferably at least 20.

If the index of modification is less than 10, positive chargeability is low, and furthermore can vary seriously among the individual toner particles. For this reason toners having a chargeability which varies with changes in the environment and with the lapse of time cannot be obtained.

The vinyl side chain-polymer portion constituting the graft copolymer to be used in the preparation of the toners of the present invention has a glass transition point of at least 40° C. If the glass transition point is less than 40° C., as described above, the toners readily cause coagulation at room temperature. The expression "glass transition point" of the vinyl side chain-polymer portion of the graft copolymer means a glass transition point (a theoretical glass transition point) as calculated from the following equation:

$$\frac{1}{Tg} = \frac{W_A}{Tg_A} + \frac{W_B}{Tg_B} + \frac{W_C}{Tg_C} + \cdots$$

where

Tg=theoretical glass transition point, $Tg_A$=saturated glass transition point of homopolymer of monomer A, $Tg_B$=saturated glass transition point of a homopolymer of monomer B, $Tg_C$=saturated glass transition point of a homopolymer of monomer C, $W_A$=ratio of the weight of monomer A to the total weight of charged monomers.

$W_B$=ratio of the weight of momoner B to the total weight of charged monomers, $W_C$=ratio of the weight of monomer C to the total weight of charged monomers.

The reason why the above-described theoretical glass transition point is used as the glass transition point of the vinyl side chain-polymer portion is that since the graft copolymer of the present invention is prepared by graft polymerizing the vinyl monomer to the crystalline polymer and the unsaturated polyester resin which have been previously polymerized, it is difficult to actually measure the glass transition point of the vinyl side chain-polymer portion, and that the theoretical glass transition point is in good agreement with the behavior of the toners.

The vinyl side chain-polymer portion is prepared from one or more of vinyl monomers containing a polymerizable vinyl group represented by the formula $CH_2=CH-$. Representative examples of such vinyl monomers include styrenes such as styrene, chlorostyrene, and α-methylstyrene; monocarboxylic acid esters such as methyl methacrylate, ethyl methacrylate, methyl acrylate, ethyl acrylate, n-butyl acrylate, dodecyl acrylate, and 2-chloroethyl acrylate; vinyl esters such as vinyl chloride, vinyl fluoride, vinyl acetate, vinyl propionate, vinyl benzoate, and vinyl butyrate; acrylic or methacrylic acid derivatives such as acrylonitrile, methacrylonitrile, and acrylamide; vinyl ethers such as vinyl methyl ether, vinyl ethyl ether, and vinyl isobutyl ether; vinyl naphthalenes; vinyl ketones such as vinyl methyl ketone, vinyl hexyl ketone, and methyl isopropenyl ketone; and N-vinyl compounds such as N-vinylpyrrole, N-vinylcarbazole, N-vinylindole, and N-vinylpyrrolidene.

With respect to the ratio of the crystalline main chain-polymer portion to the unsaturated polyeter main chain-polymer portion to the vinyl side chain-polymer portion in the graft copolymer of the present invention, the best results are obtained when the graft copolymer is designed so that the amount of the crystalline main chain-polymer portion is from 1 to 30 parts by weight, the amount of the non-crystalline polymer portion is from 99 to 70 parts by weight, and the amount of the unsaturated polyester main chain-polymer portion is from 20 to 95 parts by weight per 100 parts by weight of the non-crystalline polymer portion and the amount of the vinyl side chain-polymer portion is from 5 to 80 parts by weight per 100 parts by weight of the non-crystalline polymer portion. If the amount of the crystalline polymer portion is less than 1 part by weight, the offset-preventing effect cannot be obtained. On the other hand, if it is in excess of 30 parts by weight, the minimum fixation temperature rises and furthermore the fixability is reduced. If the amount of the unsaturated polyester main chain-polymer portion is less than 20 parts by weight, the minimum fixation temperature increases. On the other hand, if it is in excess of 95 parts by weight, the temperature range where the fixation is possible is narrowed. Similarly, if the amount of the vinyl side chain-polymer portion is less than 5 parts by weight, the temperature range where the fixation is possible is narrowed. On the other hand, it is is in excess of 80 parts by weight, the minimum fixation temperature increases. Considerable attention should be paid to the proportion of each portion in the graft copolymer so that the effect of the toners of the present invention is exhibited sufficiently. The best results are obtained within the above-specified ranges.

As the binder resin for the toners of the present invention, the above-described graft copolymer may be used singly. In addition, it may be used in combination with other resins within the range that does not deteriorate the effect of the present invention. Resins which can be used in combination with the graft copolymer of the present invention include homopolymers or copolymers of one or more of vinyl compounds such as styrenes (e.g., styrene, chlorostyrene, and α-methylstyrene), monocarboxylic acid esters (e.g., methyl methacrylate, ethyl methacrylate, methyl acrylate, ethyl acrylate, n-butyl acrylate, dodecyl acrylate, and 2-chloroethyl acrylate), vinyl esters (e.g., vinyl chloride, vinyl fluoride, vinyl acetate, vinyl propionate, vinyl benzoate, and vinyl butyrate), acrylic or methacrylic acid derivatives (e.g., acrylonitrile, methacrylonitrile, and acrylamide), vinyl ethers (e.g., vinyl methyl ether, vinyl ethyl ether, and vinyl isobutyl ether), vinyl naphthalenes, vinyl ketones (e.g., vinyl methyl ketone, vinyl hexyl ketone, and methyl isopropyl ketone), and N-vinyl compounds (e.g., N-vinylpyrrole, N-vinylcarbazole, N-vinylindole, and N-vinylpyrrolidone), and non-vinyl resins such as a rosin-modified phenol/formalin resin, an oil-modified epoxy resin, a polyurethane resin, a cellulose resin, and a polyether resin. In the case that the graft copolymer is used in combination with other resins as described above, they are compounded so that the amount of the crystalline main chain-polymer portion of the graft copolymer is at least 1% by weight based on the total weight of the binder resin, and the unsaturated polyester main chain-polymer portion and the vinyl side chain-polymer portion constitute, respectively, at least 20% by weight and 80% by weight or less of the total binder resin. Of course, even if the graft copolymer of the present invention is used singly as the binder resin for the toners, the above-described superior characteristics such as high offset-preventing ability, low temperature fixability, extended fixation temperature range, and toner productivity can be obtained, and it is not always necessary that the graft copolymer be used in combination with the above-described resins. If, however, they are used in combination with each other, the type and amount of the other resin should be chosen within the above-specified ranges.

Known pigments and dyes can be used as colorants. This colorant is added in an amount sufficient to dye the toner; the amount of the colorant added is generally up to 25% by weight, and preferably from 1 to 20% by weight, based on the total weight of the toner. Representative examples of these colorants are carbon black, Nigrosine, Aniline Blue, Calco-oil Blue, Chrome Yellow, Ultramarine Blue, Dupont Oil Red, Quinoline Yellow, Methylene Blue, Phthalocyanine Blue, Malachite Green, Lamp Black, and Rose Bengale.

When the toner contains a magnetic powder, the magnetic powder may be used as a colorant.

Various additives may be added to the toners. These additives include agents, filming-preventing agents or abrasives (such as tin oxide, zinc oxide, titanium oxide, aluminum oxide, low molecular weight fluorine-containing compounds, fluorocarbon resins, styrene resins, styrene-acrylic copolymer, silica, etc.) to prevent the formation of a toner film on a light-sensitive material, and plasticizers.

In producing the dry toners of the present invention, the above-prepared graft copolymer, the colorant, and if necessary, additives are mixed, melt kneaded, and then finely pulverized. Alternatively, a procedure may be employed in which graft copolymerization is carried out in the presence of the colorant to produce a colored resin and the thus-produced colored resin is finely pulverized, or converted into dry toners by a spray dry method.

The average particle diameter of the toners is generally about 30 μm or less, and preferably from 10 to 25 μm.

The toners of the present invention can be mixed with carrier particles to produce a developer, or they can be used singly without the use of any carrier particles to produce a developer. The average particle diameter of carrier particles to be mixed with the toners is nearly equal to or more than that of the toners. Appropriately it is up to 500 μm. Examples of these carrier particles are glass beads, sand, and particles of metal elements such as iron, nickel, and cobalt, and alloys. The carrier particles can also, optionally, be covered with various resins or other compounds. When they are used without covering with metal powder, it is desirable that the surface of the particles be subjected to oxidation treatment. The carrier particles can be spherical, plate-like, needle-like, or knot-like in form, and carrier particles having different forms may be used in combination. In addition, carrier particles having a large diameter may be used in combination with those having a small diameter. In the case that without the use of carrier particles the toners are used singly as the developer, particularly when magnetic brush development is carried out, it is preferred that a powdered magnetic substance is added to the toners. The amount of the powdered magnetic substance added is preferably from 20 to 70% by weight based on the weight of the toners. Examples of such powdered magnetic substances are powders of metals such as iron, manganese, nickel, cobalt, and chromium, alloys or compounds of iron, manganese, nickel, and cobalt, such as various ferrites and magnetites, and other ferromagnetic alloys.

Various additives may be added to the developer. Additives which can be used for this purpose include charge controlling agents, filming-preventing agents, and plasticizers.

The thus-produced developer is brought into contact with a light-sensitive material or dielectric film having a negative electrostatic latent image by the cascade developing method or magnetic brush developing method, to form a visible toner image. The toner image is once transferred to a support such as paper. Then the toner image is fixed by passing the support through a fixation apparatus. This fixation apparatus comprises a pair of rolls, viz., a heating roll and a pressing roll. The surface of rolls coming into contact with the toner image is coated with a fluorocarbon resin, such as Teflon (trade mark for product produced by DuPont) or silicone rubber, or has a metallic layer. That is, the toner image is fixed by passing the support between the above heat rolls. At this time, an offset-preventing liquid such as silicone oil can optionally be applied to the heat rolls.

The dry toners of the present invention are greatly improved over the prior toners which have been proposed by the present inventors and in which a graft copolymer comprising polyester not modified with amine, for example, is used, without deteriorating the advantages of the prior toners, in that as positively charged toners for use in positive-to-positive development of a negative electrostatic latent image their developability is stabilized against changes in the environment and with a lapse of time.

With the prior toners of the present inventors, the minimum fixation temperature can be lowered to about 120° C. and the fixable temperature range can be greatly increased from 130° C. in the condition that any offset-preventing liquid is not used: that is, the prior toners are superior in the low temperature fixation and the fixable temperature range. In addition, the prior toners have another advantage in that their developability is reduced in changes due to the environment and with a lapse of time.

When, however, such prior toners are used as positively charged toners for use in the development of negative electrostatic latent images, only poor quality copies which are heavily fogged are obtained from the start of the copying. When several hundred copies are produced, the density of the image areas cannot be increased, and the developer is entirely deteriorated.

Furthermore, when these toners are used in combination with a positively chargeable charge controlling agent such as Nigrosine, good developability can be obtained in the initial stage, but the image density gradually decreases and phenomena such as increase in fog occur, and ultimately, the development is no longer possible.

In summary, such prior toners cannot be usefully employed as positively charged toners.

In contrast with the prior toners, when the toners of the present invention are used as positively charged toners for use in development of negative electrostatic latent images, even if 100,000 copies are produced, the image quality does not almost change; that is, they have greatly stabilized developability.

The toners of the present invention are compatible with prior toners in connection with fixability, i.e., the minimum fixation temperature is 120° C. and the fixable temperature range is about 130° C.

The present inventors have succeeded in producing positively charged toners which exhibit a low temperature fixation and an extended fixable temperature range in the absence of an offset-preventing liquid, and which show stabilized developability.

The present invention is described in further detail with reference to the following examples.

COMPARATIVE EXAMPLE 1

A four-necked flask was charged with 120 g of polypropylene ($\overline{Mn}=5{,}000$, $T_M=150°$ C.), 800 ml of xylene, and 15 g of tert-butylhydroxy peroxide. The mixture was raised in temperature to the reflux temperature of xylene while stirring and then maintained at this temperature. While the mixture was maintained at that temperature, 1,080 g of a mixture of 65 parts by weight of styrene and 35 parts by weight of n-butyl methacrylate was dropped over 4 hours through a dropping funnel. After the dropwise addition was completed, the mixture was further stirred for 1 hour at the reflux temperature of xylene. After the polymerization was completed, the mixture was cooled to room temperature, freed of the solvent, and vacuum dried to yield the reaction product.

The above reaction product was a graft copolymer comprising a propylene main chain-polymer portion and a styrene/n-butyl methacrylate side chain-polymer portion. Regarding the molecular weight of the graft copolymer, $\overline{Mn}$ was 18,500 and $\overline{Mw}$ was 70,600.

Then, 90 parts by weight of the graft copolymer and 10 parts by weight of carbon black were mixed, melt kneaded, and finely pulverized to produce toners having an average particle diameter of 13 μm.

Then, 2 parts by weight of the toners were mixed with 100 parts by weight of a powdered iron oxide carrier having an average particle diameter of 100 μm to produce a developer.

An electrostatic latent image formed on an Se-based light-sensitive material was developed with the above-produced developer by the use of a magnetic brush. The thus-formed toner image was transferred to a transfer paper and fixed by the use of a heat roll. In this case, an offset-preventing liquid was not applied. The fixability of the developer was examined at varied heat roll temperatures. It was found that the minimum fixation temperature was about 160° C. and the temperature at which the offset was observed to a slight extent was about 250° C., that is, the fixable temperature range was 90° C.

COMPARATIVE EXAMPLE 2

A four-necked flask was charged with 120 g of polypropylene ($\overline{M}n=5,000$, $T_M=150°$ C.), 600 g of a polyester resin containing an unsaturated bond in the main chain prepared from bisphenol A, propylene glycol, and fumaric acid (Tg=40° C., $\overline{M}n=2,000$), 800 ml of xylene, and 11 g of tert-butyl peroxide. The mixture was raised in temperature to the reflux temperature of xylene. While maintaining the mixture at that temperature, 480 g of a mixture of 65 parts by weight of styrene and 35 parts by weight of n-butyl methacrylate was dropped over 4 hours through a dropping funnel. After the dropwise addition was completed, the mixture was further stirred for 1 hour at the reflux temperature of xylene. After the polymerization was completed, the reaction mixture was cooled to room temperature, freed of the solvent, and then vacuum dried to yield the reaction product.

The above reaction product was a graft copolymer having a propylene main chain-polymer portion, an unsaturated polyester main chain-polymer portion, and a styrene/n-butyl methacrylate side chain-copolymer portion. Tg of the styrene/n-butyl methacrylate copolymer portion (theoretical Tg for a homopolymer which was not grafted) was 68° C., Tg of the graft copolymer was 40° C., and the molecular weight was such that $\overline{M}n$ was 4,600 and $\overline{M}w$ was 88,000. Then, 90 parts by weight of the graft copolymer and 10 parts by weight of carbon black were mixed, melt kneaded, and then finely pulverized to produce toners having an average particle diameter of 13 μm. Then, 2 parts by weight of the above-produced toners were mixed with 100 parts by weight of a powdered iron oxide carrier having an average particle diameter of 100 μm to produce a developer.

An electrostatic latent image formed on an Se-based light-sensitive material was developed with the above-produced developer by the use of a magnetic brush. The thus-formed toner image was transferred to a transfer paper and fixed by the use of a heat roll. In this case, an offset-preventing liquid was not applied. The fixability of the developer was examined at varied heat roll temperatures. It was found that the minimum fixation temperature was about 120° C. and the temperature at which the offset was observed to a slight extent was about 250° C.; that is, the fixable temperature range was 130° C. By comparison with the results of Comparative Example 1, it was confirmed that the minimum fixation temperature could be lowered by 40° C., and thus the fixable temperature range could be extended by 40° C.

The above-produced developer was used in a transfer-type copying machine where a negative electrostatic latent image was to be formed. The formation of fog in the background was predominant from the start of copying. At the time when several hundred copies were produced, the density of the image areas could not be increased. Thus the developer could not be used any more.

Thus it is judged that the service life of the developer as a positively charged toner is only several hundred copies.

COMPARATIVE EXAMPLE 3

To 90 parts by weight of the same binder as used in Comparative Example 2 were added 1 part by weight of cetylpyridinium chloride and 10 parts by weight of carbon black, and the resulting mixture was treated in the same manner as in Comparative Example 2 to produce toners having an average paricle diameter of 13 μm. Then 2 parts by weight of the above-produced toners and 100 parts by weight of a powdered iron oxide carrier having an average particle diameter of 100 μm were mixed to produce a developer.

The thus-produced developer was used to develop in a transfer-type copying machine where a negative electrostatic latent image was to be formed, whereupon a sharp image was obtained. Even at the time when 50,000 copies were produced, images of the same quality as that at the start of copying could be obtained. When 100,000 copies were produced, the image density could not be increased. It thus appeared that the developer could not be used any more.

It is thus judged that the service life of the developer is about 100,000 copies.

The above developer was evaluated for fixability in the same manner as in Comparative Examples 1 and 2. The minimum fixation temperature was 170° C., which was higher than that of Comparative Example 1. As a result of incorporation of cetylpyridinium chloride, the low fixation temperature as obtained in Comparative Example 2 could not be obtained. The offset was observed at 250° C. to a slight extent.

EXAMPLE 1

A four-necked flask was charged with 600 g of modified polyester (Tg=43° C., $\overline{M}n=2,600$) as prepared by modifying —COOH groups of the same polyester resin as used in Comparative Example 2 with dimethylaminoethanol, 120 g of polypropylene, 800 ml of xylene, and 11 g of tert-butyl peroxide.

Thereafter the same procedure as in Comparative Example 2 was repeated to produce a graft copolymer (Tg=43° C., $\overline{M}n=91,000$). The acid value of the graft copolymer was 10 mg KOH/g.

The acid value of the graft copolymer of Comparative Example 2 was 23 mg KOH/g. Thus the index of replacement of COOH with amine was 56.

A mixture of 90 parts by weight of the graft copolymer and 10 parts by weight of carbon black was processed in the same manner as in Comparative Example 2 to produce toners having an average particle diameter of 13 μm. Using these toners, a developer was produced also in the same manner as in Comparative Example 2.

The thus-produced developer was evaluated for fixability in the same manner as in Comparative Example 2. The minimum fixation temperature was 120° C. and the offset was observed at 250° C. to a slight extent.

The developer was used to develop in a transfer-type copying machine where a negative electrostatic latent image was to be formed, whereupon a very sharp image could be obtained. No change was observed even after 100,000 copies were produced.

It was thus confirmed that the modification of —COOH with amine brought about a marked improvement over the results of Comparative Example 2 in developability as positively charged toners for use in development of a negative electrostatic latent image and also in the service life without the loss of the low temperature fixation and the extended fixable temperature range of Comparative Example 2.

EXAMPLE 2

A great copolymer (Tg=43° C., $\overline{M}n$=4,900, $\overline{M}w$=87,000) was produced in the same manner as in Example 1 except that triethylenetetamine was used in place of dimethylaminoethanol. The acid value was 8.6 mg KOH/g. Thus the index of replacement was 63.

The above-produced graft copolymer was used to produce toners and then a developer in the same manner as in Example 1.

The minimum fixation temperature of the above developer was 125° C., and the temperature at which the offset was produced was 250° C. In development of negative electrostatic latent images, even after 100,000 copies were produced, sharp images could be obtained; the toners were stabilized positively charged toners.

EXAMPLE 3

A graft copolymer (Tg=44° C., $\overline{M}n$=94,000) was produced in the same manner as in Example 1 except that a polyester to which, after modification with dimethylaminoethanol, sodium monochloroacetate was added to in an amount of 1/5 based on the weight of dimethylaminoethanol added, i.e., in a molar ratio of dimethylaminoethanol to sodium monochloroacetate of 1/6.5. The acid value was 90 mg KOH/g, and the index of replacement was 61. That is, the graft copolymer had a main chain-polyester in which 15% of amine, i.e., 9% of the —COOH was betainized.

The above-produced graft copolymer was used to produce toners and then a developer in the same manner as in Example 1.

The minimum fixation temperature was 130° C., and the offset was formed to a slight extent at 250° C.

In positive-to-positive development of negative electrostatic latent images, even after 100,000 copies were produced, sharp images could be obtained.

EXAMPLE 4

A graft copolymer (Tg=46° C., $\overline{M}n$=5,300, $\overline{M}w$=79,000) was produced in the same manner as in Example 1 except that a polyester to which, after modification with diethanolamine, dimethyl sulfoxide was added in an amount of ¼ based on the weight of diethanolamine, i.e., in a molar ratio of diethanolamine to dimethyl sulfoxide of 1/5. The acid value was 10.6 mg KOH/g. Thus the index of replacement was 54. That is, the graft copolymer had a main chain-polyester in which 20% of amine, i.e., 11% of the —COOH was ammoniated.

The above-produced graft copolymer was used to produce toners and then a developer in the same manner as in Example 1.

The minimum fixation temperature was 128° C., and the offset was formed to a slight extent at 250° C.

As a developer for use in positive-to-positive development of negative electrostatic latent images, the above-produced developer had a service life such that more than 100,000 copies could be produced.

Replacement of part of the —COOH groups of the polyester with nitrogen-containing functional groups such as amine and ammonium permits overcoming the defects of the prior art techniques wherein it is difficult to produce a positively chargeable toner without loss of the advantage of the polyester that the low temperature fixability is superior, and also to produce toners which are suitable for use in a transfer type copying machine, are superior in low temperature fixation, have an extended fixation temperature range, and further which are positively chargeable.

While the invention has been described in detail and with reference to specific embodiments thereof, it will be apparent to one skilled in the art that various changes and modifications can be made therein without departing from the spirit and scope thereof.

What is claimed is:

1. A dry toner for use in electrostatic latent image development comprising a colorant in a resin binder, wherein said resin binder comprises a graft copolymer comprising (a) a crystalline main chain-polymer portion of at least one selected from the group consisting of ethylene, propylene, and vinyl acetate, (b) an unsaturated polyester main chain-polymer portion containing —COOH groups, and (c) a vinyl side chain-polymer portion, wherein at least one of the —COOH groups in the unsaturated polyester main chain polymer is modified with a nitrogen-containing functional group selected from an amine, an ammonium salt, a betaine, a pyridinium salt, and an azine, wherein the index of modification of —COOH groups in the polyester portion, as represented by the expression $$\frac{A.V._0 - A.V.}{A.V._0} \times 100$$

wherein $A.V._0$ is the acid value of the polyester main chain polymer prior to the modification, and A.V. is the acid value of the polyester main chain polymer after the modification, is at least 10.

2. A dry toner as in claim 1, wherein the glass transition point of the polyester is from 40° to 70° C.

3. A dry toner as in claim 1, wherein the glass transition point of the vinyl side chain-polymer portion is at least 40° C.

4. A dry toner as in claim 1, wherein the melting point of the crystalline polymer portion is from 45° to 200° C.

5. A dry toner as in claim 1, wherein the graft copolymer comprises from 1 to 30 parts by weight of a crystalline polymer portion and from 99 to 70 parts by weight of a non-crystalline polymer portion comprising from 20 to 95 parts by weight of the unsaturated polyester and from 5 to 80 parts by weight of the vinyl side chain-polymer per 100 parts by weight of the non-crystalline polymer portion.

6. A dry toner as in claim 1, wherein the index of modification of the —COOH groups of the polyester is at least 20.

7. A dry toner as in claim 1, wherein the glass transition point of the graft copolymer is from 40° to 70° C.

8. A dry toner as in claim 1, wherein the electrostatic image has a negative polarity.

9. A dry toner as in claim 1, wherein said graft copolymer is modified by reacting it with a nitrogen-containing modifier.

10. A dry toner as in claim 9, wherein the nitrogen-containing modifier contains a functional group reactive with —COOH, and also contains a group selected from the group consisting of $NH_2$, NHR and $NR_2$, wherein R represents an alkyl group.

11. A dry toner as in claim 10, wherein said nitrogen-containing modifier is selected from the group consisting of diethanolamine, dimethylaminoethanol, triethanolamine, oxazolidine, polyphenyl biguanide, polyalkyleneamine, diethylenetriamine, triethylenetetramine, 2-mono-hydroxyethylamino-4,6-diamino-s-triazine, 2-isopropoxy-4,6-diamino-s-triazine, and 2-methoxy-4,6-diamino-s-triazine.

12. A dry toner as in claim 1, wherein said polyester containing —COOH groups is modified by reacting it with a nitrogen-containing modifier to modify at least one of the —COOH groups with an amine and then further reacting the resultant amine-modified polyester with a quaterization agent.

13. A dry toner as in claim 12, wherein the quaterization agent is selected from the group consisting of

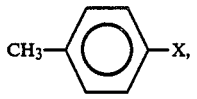

$(CH_3)_2SO_4$, and $CH_3X$ wherein X is a halogen atom.

14. A dry toner as in claim 1, wherein said polyester containing —COOH groups is modified by reacting it with a nitrogen-containing modifier to modify at least one of the —COOH groups with an amine and further reacting the resulting amine-modified polyester with a betanization agent.

15. A dry toner as in claim 14, wherein the betanization agent is $ClCH_2COONa$ or

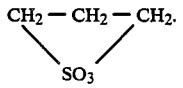

16. A dry toner as in claim 1, wherein said polyester containing COH groups is modified by reacting it with a nitrogen-containing modifier to modify at least one of the —COOH groups with an amine and then further reacting the resulting amine-modified polyester with an azine or a pyridinium salt.

17. A dry toner as in claim 1, wherein said at least one of the —COOH groups is a terminal —COOH group or a side-chain —COOH group of the polyester.

18. A dry toner as in claim 1, wherein said unsaturated polyester main chain polymer is a polymer obtained by polymerization of at least one dihydric alcohol selected from the group consisting of ethylene glycol, triethylene glycol, 1,2-propylene glycol, 1,3-propylene glycol, 1,4-butanediol, neopentyl glycol, 1,4-butenediol, 1,4-bis(hydroxymethyl)-cyclohexane, bisphenol A, hydrogenated bisphenol A, and polyoxyethylenated bisphenol A and at least one dibasic acid selected from the group consisting of maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid and malonic acid, or anhydrides or lower alcohol esters thereof.

19. A dry toner as in claim 1, wherein said unsaturated polyester main chain polymer is a polymer obtained by polymerization of at least one dihydric alcohol selected from the group consisting of ethylene glycol, triethylene glycol, 1,2-propylene glycol, 1,3-propylene glycol, 1,4-butanediol, neopentyl glycol, 1,4-butenediol, 1,4-bis(hydroxymethyl)-cyclohexane, bisphenol A, hydrogenated bisphenol A, and polyoxyethylenated bisphenol A and at least one dibasic acid selected from the group consisting of maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid and malonic acid, or anhydrides or lower alcohol esters thereof and at least one of alcohols and carboxylic acids having a valency of three or more and being selected from the group consisting of glycerin, trimethylolpropane, pentaerythritol, trmellitic acid and pyromellitic acid.

* * * * *